US009756418B2

(12) United States Patent
Iseki et al.

(10) Patent No.: US 9,756,418 B2
(45) Date of Patent: Sep. 5, 2017

(54) SOUND REPRODUCTION DEVICE, SOUND REPRODUCTION METHOD AND SOUND REPRODUCTION PROGRAM

(71) Applicant: PIONEER CORPORATION, Kanagawa (JP)

(72) Inventors: Akihiro Iseki, Kawagoe (JP); Yoshitomo Imanishi, Kawagoe (JP)

(73) Assignee: PIONEER CORPORATION, Kanagawa (JP)

( * ) Notice: Subject to any disclaimer, the term of this patent is extended or adjusted under 35 U.S.C. 154(b) by 52 days.

(21) Appl. No.: 14/767,300

(22) PCT Filed: Feb. 13, 2013

(86) PCT No.: PCT/JP2013/053408

§ 371 (c)(1),
(2) Date: Aug. 12, 2015

(87) PCT Pub. No.: WO2014/125581

PCT Pub. Date: Aug. 21, 2014

(65) Prior Publication Data

US 2016/0014505 A1 Jan. 14, 2016

(51) Int. Cl.

| | |
|---|---|
| ***H04R 1/40*** | (2006.01) |
| ***H04R 3/12*** | (2006.01) |
| ***H04R 5/00*** | (2006.01) |
| ***H04R 5/02*** | (2006.01) |
| ***H04S 7/00*** | (2006.01) |
| ***G10K 15/00*** | (2006.01) |

(52) U.S. Cl.

CPC ..... *H04R 1/403* (2013.01); *H04R 3/12* (2013.01); *H04R 2499/13* (2013.01)

(58) Field of Classification Search

USPC ..... 381/17, 303, 97

See application file for complete search history.

(56) References Cited

U.S. PATENT DOCUMENTS

2011/0103590 A1* 5/2011 Christoph ..... H04S 7/302 381/17
2012/0281858 A1* 11/2012 Margaliot ..... H04R 3/12 381/97

FOREIGN PATENT DOCUMENTS

JP H01-248800 A 10/1989
JP 06-022388 A * 1/1994

(Continued)

OTHER PUBLICATIONS

International Search Report PCT/JP2013/053408 dated Mar. 26, 2013.

*Primary Examiner* — Duc Nguyen
*Assistant Examiner* — Yogeshkumar Patel
(74) *Attorney, Agent, or Firm* — Young & Thompson

(57) ABSTRACT

The above sound reproduction device is applied to an acoustic space such as a passenger compartment, and controls the levels of the reproduced sounds at two evaluation points set at the seats in the passenger compartment, for example. Specifically, the sound reproduction device controls the phase of the sound signal inputted from external and supplies the sound signals to the pair of speakers. The phase control is performed for each of the plurality of listening positions such that a sum of reproduced sound levels at the two evaluation points becomes larger than the sum obtained in a case where the sound signal is reproduced only one of the pair of speakers.

20 Claims, 15 Drawing Sheets

(56) References Cited

FOREIGN PATENT DOCUMENTS

| | | |
|---|---|---|
| JP | 2000-261900 | 9/2000 |
| JP | 2011-097561 | 5/2011 |
| JP | 4757034 | 6/2011 |
| JP | 2011-151559 | 8/2011 |
| JP | 2012-257079 | 12/2012 |

* cited by examiner

D1=dF1- dR1、 D2=dF2- dR2
D=|D1- D2|

・UPPER LIMIT FREQUENCY BAND $F_{max}$ :
"F" satisfying F・D/c<1/3

・RANGE OF PHASE DIFFERENCE θ:
A-120° + D・F/c × 360° < θ < A+120°
A: PHASE DIFFERENCE HAVING LARGEST SOUND AT POSITION OF LISTENER L1

DRIVER'S SEAT

ASSISTANT DRIVER'S SEAT

REAR SEAT

2ND EMBODIMENT

DRIVER'S SEAT

ASSISTANT DRIVER'S SEAT

REAR SEAT

D1=f1-r1
D2=f2-r2

D1≒D2

D1≠D2

SOUND REPRODUCTION DEVICE, SOUND REPRODUCTION METHOD AND SOUND REPRODUCTION PROGRAM

TECHNICAL FIELD

The present invention relates to a technique of adjusting a level of sound that a listener listens to in an acoustic space.

BACKGROUND TECHNIQUE

There is proposed a technique of adjusting a sound pressure level of reproduced sound in an acoustic space such as a passenger compartment. For example, Patent Reference 1 proposes a technique of correcting a level of reproduced sound at each frequency band by an equalizer thereby to adjust the sound pressure level in accordance with the acoustic space and a listening position. Also, Patent Reference 2 proposes a method of arranging a speaker array including a plurality of speakers and controlling a phase and a sound volume of a sound signal outputted by each speaker, thereby to create a high sound pressure area at a certain position.

PRIOR ART REFERENCE

Patent Reference

Patent Reference 1: Japanese Patent No. 4757034

Patent Reference 2: Japanese Patent Application Laid-open under No. 2011-151559

SUMMARY OF INVENTION

Problem to be Solved by the Invention

Generally, a listener at a driver's seat or an assistant driver's seat feels that the sound from a rear speaker is smaller than the sound from a front speaker and is difficult to listen. This is because the sound outputted by the rear speaker is shielded by the seat and reflected by the window.

In order to make the reproduced sound from the rear speaker easy to listen at the driver's seat or the assistant driver's seat, there is proposed a method like Patent Reference 1 which utilizes an equalizer to increase the level of the reproduced sound at a certain frequency band. In this method, however, there is such a disadvantage that the sound volume is too large for a passenger at the rear seat because the sound volume of the rear speaker is increased.

On the other hand, there is conceivable a method of increasing the sound pressure around the driver's seat by using a speaker array, like Patent Reference 2. However, the method of Patent Reference 2 is unfit for a vehicle because it needs a large system to control a plurality of speakers.

The above is one example of a problem to be solved by the present invention. It is an object of the present invention to provide a sound reproduction device capable of increasing the reproduced sound level at a certain listening position without giving a bad influence to the environment and without requiring a large system.

Means for Solving the Problem

The invention described in claims is a sound reproduction device comprising: a pair of speakers arranged in front of and behind a plurality of listening positions each having two evaluation points set in an acoustic space; an input unit which receives a sound signal; and a phase control unit which controls a phase of the sound signal and supplies the sound signals to the pair of speakers, wherein the phase control unit determines, for each of the plurality of listening positions, a control frequency band and a phase difference such that a sum of reproduced sound levels at the two evaluation points becomes larger than the sum obtained in a case where the sound signal is reproduced only one of the pair of speakers, and controls the sound signals supplied to the pair of speakers.

The invention described in claims is a sound reproduction method executed by a sound reproduction device including a pair of speakers arranged in front of and behind a plurality of listening positions having two evaluation points set in an acoustic space, comprising: an input process which receives a sound signal; and a phase control process which controls a phase of the sound signal and supplies the sound signals to the pair of speakers, wherein the phase control process determines, for each of the plurality of listening positions, a control frequency band and a phase difference such that a sum of reproduced sound levels at the two evaluation points becomes larger than the sum obtained in a case where the sound signal is reproduced only one of the pair of speakers, and controls the sound signals supplied to the pair of speakers.

The invention described in claims is a sound reproduction program executed by a sound reproduction device including a pair of speakers arranged in front of and behind a plurality of listening positions having two evaluation points set in an acoustic space, making the sound reproduction device function as: an input unit which receives a sound signal; and a phase control unit which controls a phase of the sound signal and supplies the sound signals to the pair of speakers, wherein the phase control unit determines, for each of the plurality of listening positions, a control frequency band and a phase difference such that a sum of reproduced sound levels at the two evaluation points becomes larger than the sum obtained in a case where the sound signal is reproduced only one of the pair of speakers, and controls the sound signals supplied to the pair of speakers.

DETAILED DESCRIPTION OF THE PREFERRED EMBODIMENTS

Figure 1:
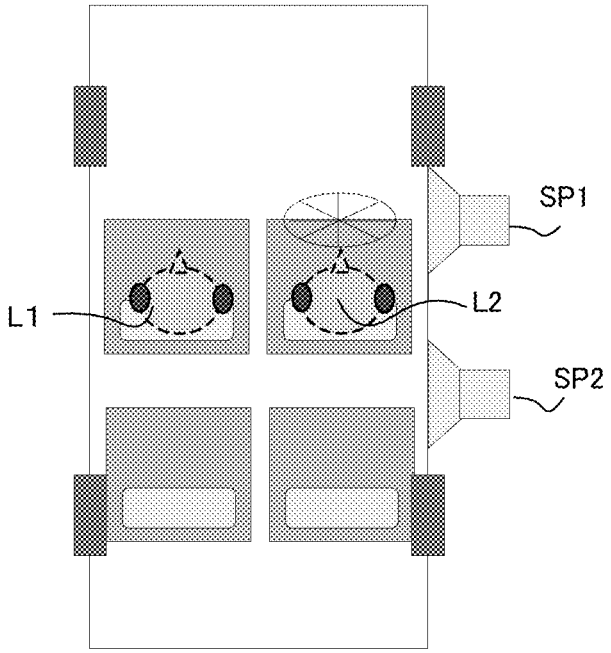
FIG. 1 is a plan view schematically illustrating an environment in a passenger compartment.

According to one aspect of the present invention, there is provided a sound reproduction device comprising: a pair of speakers arranged in front of and behind a plurality of listening positions each having two evaluation points set in an acoustic space; an input unit which receives a sound signal; and a phase control unit which controls a phase of the sound signal and supplies the sound signals to the pair of speakers, wherein the phase control unit determines, for each of the plurality of listening positions, a control frequency band and a phase difference such that a sum of reproduced sound levels at the two evaluation points becomes larger than the sum obtained in a case where the sound signal is reproduced only one of the pair of speakers, and controls the sound signals supplied to the pair of speakers.

The above sound reproduction device is applied to an acoustic space such as a passenger compartment, and controls the levels of the reproduced sounds at two evaluation points of two listening positions set at the seats in the passenger compartment, for example. Specifically, the sound reproduction device controls the phase of the sound signal inputted from external and supplies the sound signals to the pair of speakers. At that time, the phase control is performed for each of the plurality of listening positions such that a sum of reproduced sound levels at the two evaluation points becomes larger than the sum obtained in a case where the sound signal is reproduced only one of the pair of speakers. Therefore, the reproduction of the sound signal can be controlled such that the reproduced sound is clearly listened to at the plurality of listening positions in the acoustic space.

In a preferred example of the above sound reproduction device, the phase control unit calculates the control frequency band and the phase difference based on distances between the pair of speakers and the listening points. In another preferred example, the phase control unit determines the control frequency band and the phase difference based on measured data obtained by collecting sound reproduced by the speakers at the listening positions.

In one mode of the above sound reproduction device, one of the pair of speakers is arranged on an opposite side of the other of the pair of speakers with respect to a line segment connecting the plurality of listening positions. Thus, the sound outputted from two speakers can be synchronized to effectively increase its level.

In a preferred example, the two evaluation points correspond to positions of two ears of a listener positioned at the listening position. Also, in another preferred example, the sound space is a passenger compartment of a vehicle, the pair of speakers are a front speaker and a rear speaker arranged at a right side or a left side in the passenger compartment, the plurality of listening positions correspond to a driver's seat and an assistant driver's seat in the passenger compartment, and the two evaluation points correspond to positions of left and right ears of a listener positioned at the driver's seat and the assistant driver's seat.

According to another aspect of the present invention, there is provided a sound reproduction method executed by a sound reproduction device including a pair of speakers arranged in front of and behind a plurality of listening positions having two evaluation points set in an acoustic space, comprising: an input process which receives a sound signal; and a phase control process which controls a phase of the sound signal and supplies the sound signals to the pair of speakers, wherein the phase control process determines, for each of the plurality of listening positions, a control frequency band and a phase difference such that a sum of reproduced sound levels at the two evaluation points becomes larger than the sum obtained in a case where the sound signal is reproduced only one of the pair of speakers, and controls the sound signals supplied to the pair of speakers.

According to still another aspect of the present invention, there is provided a sound reproduction program executed by a sound reproduction device including a pair of speakers arranged in front of and behind a plurality of listening positions having two evaluation points set in an acoustic space, making the sound reproduction device function as: an input unit which receives a sound signal; and a phase control unit which controls a phase of the sound signal and supplies the sound signals to the pair of speakers, wherein the phase control unit determines, for each of the plurality of listening positions, a control frequency band and a phase difference such that a sum of reproduced sound levels at the two evaluation points becomes larger than the sum obtained in a case where the sound signal is reproduced only one of the pair of speakers, and controls the sound signals supplied to the pair of speakers.

Embodiments

[Basic Principle]

First, a basic principle of the preferred embodiments will be described. The embodiments aim to increase the sound pressure level at a specific position in an acoustic space such as a passenger compartment, for example, at the driver's seat and the assistant driver's seat. For that purpose, the embodiments utilize a special environment in a passenger compartment.

FIG. 1 is a plan view schematically showing an environment in a vehicle according to the embodiments. In FIG. 1, there are four seats in the vehicle. A listener L1 is seated at the assistant driver's seat corresponding to one listening position, and a listener L2 (driver)) is seated at the driver's seat corresponding to another listening position. Here, on the right side of the driver's seat, a front speaker SP1 and a rear speaker SP2 are arranged. While a front speaker and a rear speaker are similarly arranged on the left side of the vehicle in an actual vehicle, the illustration thereof is omitted here.

As shown in FIG. 1, the embodiments utilize such a special environment of the vehicle that two speakers SP1 and SP2 are arranged at the front side and the rear side in a manner sandwiching the driver's seat and the assistant driver's seat. In the embodiments, the sound pressure levels at the left and right ears of the listeners L1, L2 are simultaneously controlled so that the listener L1 at the assistant driver's seat and the listener L2 at the driver's seat can easily listen to the reproduced sound. In the following description, the subscript will be omitted to simply express as "the listener L" when two listeners L1 and L2 are not distinguished from each other.

Generally, the magnitude of the sound perceived by a human being is determined based on a value obtained by summing up the sound intensity at both ears. Namely, a human being perceives the sound of same magnitude when he or she listens to the sound of sound pressure 6 dB by both ears and when he or she listens to the sound of sound pressure 12 dB by one ear. This is pointed out in the following document.

Reference: Hisao Sakai, Takeshi Nakajima, "Hearing and Acoustic Psychology", Corona Publishing, CO., LTD., pp. 173-174, "The sound magnitude listened by both ears is equal to the sound magnitude when the sound pressure levels to both ears are increased by 6 dB and listened by one ear".

Therefore, in the embodiments, the positions of left and right ears of the listeners L1, L2 are set to evaluation points, respectively, and the signals inputted to the speakers SP1 and SP2 are controlled such that the sum of the sound pressure levels at those two evaluation points becomes large for each of the listeners. Thus, the listeners L1 and L2 feel the reproduced sound large.

Figure 2:
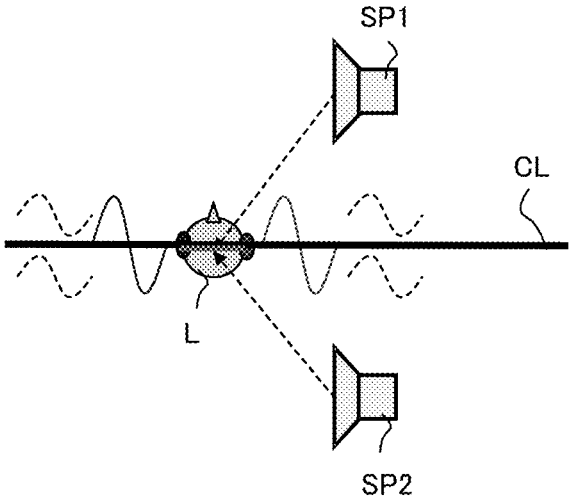
FIG. 2 illustrates an example of arrangement of a listening position and a pair of speakers.

Here, the positional relation between the listener L and the pair of speakers SP1 and SP2 will be studied first. As shown in FIG. 2, in a case where the listener L is positioned on the center line CL at equal distances from the pair of speakers SP1 and SP2 and the both ears of the listener L are on the center line CL, the listener L can listens to the sound outputted by the speakers SP1 and SP2 synchronously. Namely, the sum of the sound pressure levels at both ears of the listener L (hereinafter referred to as "both-ear level sum") becomes maximum.

Therefore, if the speakers SP1 and SP2 can be arranged in the positional relation of FIG. 2 with respect to the driver's seat and the assistant driver's seat, the both-ear level sum of the listener L1 at the assistant driver's seat becomes maximum and the both-ear level sum of the listener L2 at the driver's seat becomes maximum at the same time, by merely outputting the sound signals from those two speakers SP1 and SP2. In this case, it is not necessary to apply any processing or adjustment to the sound signals supplied to the speakers SP1 and SP2.

However, in an actual passenger compartment, two speakers SP1 and SP2 cannot be necessarily arranged in the positional relation of FIG. 2 with respect to the driver's seat and the assistant driver's seat. Therefore, in the embodiments, an appropriate phase difference is given to the sound signals supplied to two speakers SP1 and SP2 so as to increase the both-ear level sum at the driver's seat and the assistant driver's seat.

Figure 3A:
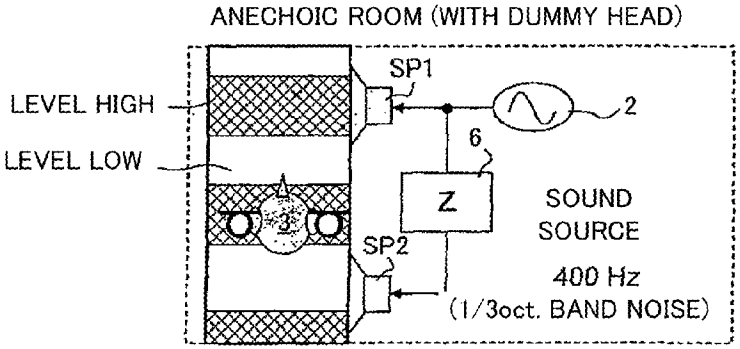
FIGS. 3A and 3B schematically illustrate a method of giving a phase difference to sound signals supplied to two speakers.
Figure 3B:
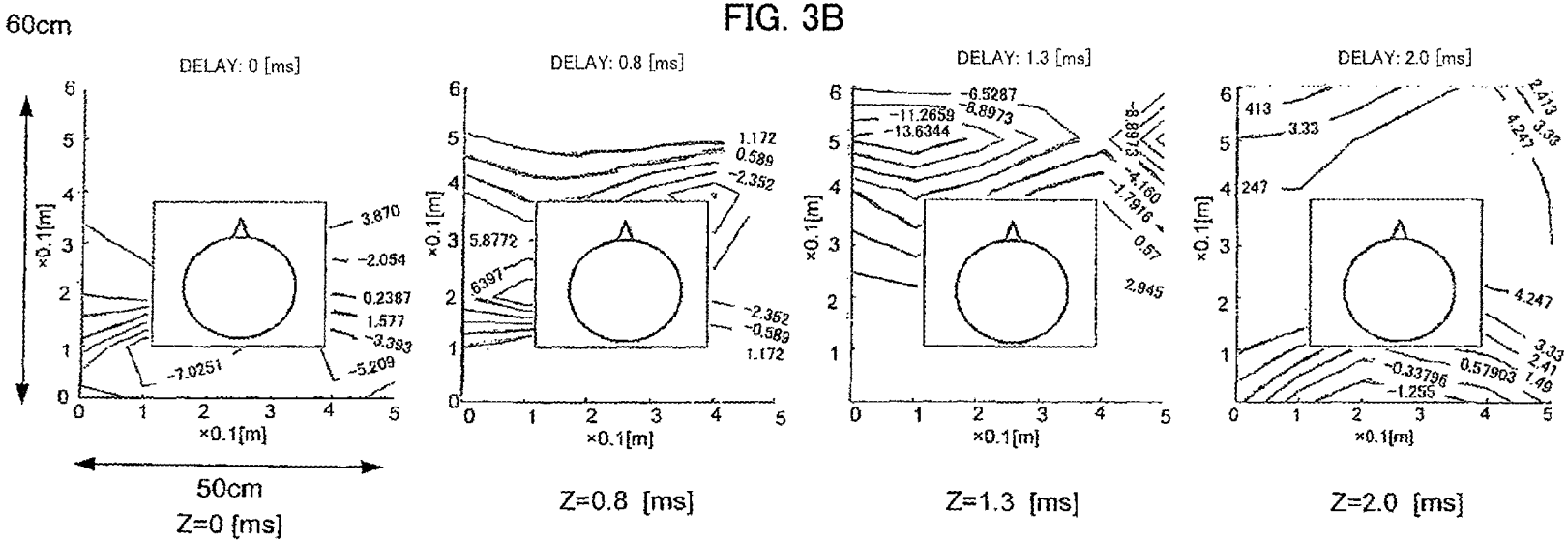

FIGS. 3A and 3B schematically shows a method of giving a phase difference to the sound signals supplied to two speakers SP1 and SP2. FIG. 3A shows a configuration for supplying sound signals to two speakers SP1 and SP2. In an anechoic room, a dummy head 3 is arranged at the listening position, and a front speaker SP1 and a rear speaker SP2 are arranged in front of and behind the dummy head 3 on the right side. The sound signal from the sound source 2 is inputted to the front speaker SP1 as it is and inputted to the rear speaker SP2 after being delayed by a fixed delay amount "Z" in an entire frequency band by the delay 6.

As shown in FIG. 3A, in a case where a pair of speakers are arranged in a longitudinal direction, the sound pressure distribution of the reproduced sound outputted by the speakers has lateral stripes due to interference. Specifically, in FIG. 3A, the black areas including the position of the dummy head 3 have the large sound pressure level, and the white areas have the small sound pressure level, thus forming the lateral stripes. Therefore, by varying the delay amount Z, it is possible to vary the levels of both ears synchronously to control the both-ear level sum.

FIG. 3B shows the examples of the sound pressure distribution around the dummy head 3 when the delay amount Z is varied. The value of the contour line indicates the sound pressure level. In the example shown in FIG. 3B, when the delay amount Z=2.0 [ms], the sound pressure level near the both ears of the dummy head 3 becomes the maximum value, 4.247 [dB]. Therefore, the delay amount Z=2.0 [ms] is optimum in this example.

In this way, by arranging a pair of speakers in front of and behind the position of the listener and giving an appropriate phase difference to the sound signals supplied to those speakers, the both-ear level sum of the listener can be increased.

1st Embodiment

Figure 4:
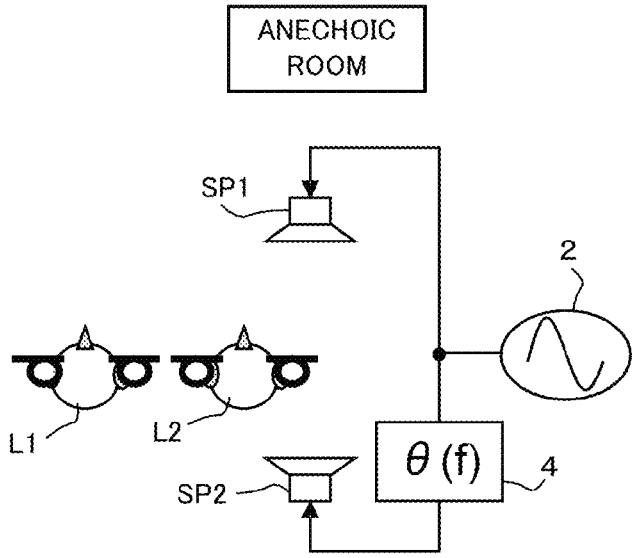
FIG. 4 illustrates a schematic configuration of a first embodiment of a sound reproduction device according to the present invention.

FIG. 4 shows a schematic configuration of a sound reproduction device according to a first embodiment. The first embodiment assumes an anechoic room as the acoustic space.

As shown in FIG. 4, a pair of speakers, i.e., a front speaker SP1 and a rear speaker SP2, are arranged in front of and behind the listening positions of the listeners L1 and L2 In this example, the front speaker SP1 is farther than the rear speaker SP2 from the listeners L1 and L2.

The sound signal outputted by the sound source 2 is supplied to the front speaker SP1 as it is, and is supplied to the rear speaker SP2 after being given a phase difference θ(f) by the phase control unit 4. The phase control unit 4 gives the phase difference θ(f), for each frequency band, to the sound signal outputted by the sound source 2.

A method of determining the phase difference θ(f) will be described below. The phase difference θ(f) is determined such that the both-ear level sum of the listener L1 and the both-ear level sum of the listener L2 become large at the same time. It is noted that the positions of the both ears of the listeners L1, L2 correspond to two evaluation points, respectively.

Figure 5:
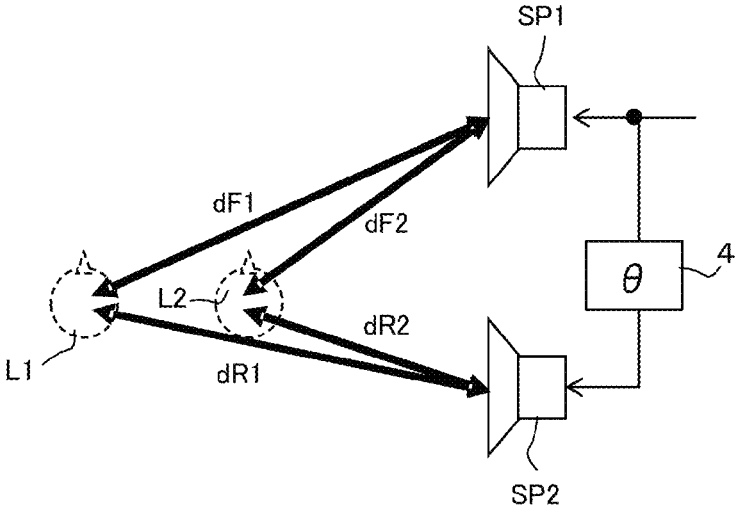
FIG. 5 shows an example of calculating a control frequency band and a phase difference.

The phase difference θ(f) can be determined based on the distances between the positions of the both ears of the listeners L1, L2 and the front and rear speakers SP1 and SP2. FIG. 5 illustrates the method of determining the phase difference θ(f). For the sake of simplicity, the center point of the head is regarded as the evaluation point.

Basically, assuming that the distance from the center point of the both ears, i.e., the center point M of two evaluation points, to the front speaker SP1 is "d1" and the distance from the center point M to the rear speaker SP2 is "d2", the delay amount Z is given by the following equation:

$$\text{Delay amount } Z=(d1-d2)/c \text{ [m/s]} \quad (1)$$

wherein "c" is sound velocity (approximately 340 [m/s]).

By giving this delay amount Z to the sound signal reproduced from the front speaker SP1 and the sound signal reproduced from the rear speaker SP2 for each frequency band, the distance differences between the listeners and two speakers are corrected, and the both-ear level sum of the listener becomes maximum. Therefore, based on the delay amount caused by the distance difference between the listeners and the two speakers as well as the frequency of the reproduced sound signal, the phase difference θ(f) to be given to the sound signal outputted from two speakers at each frequency band is calculated.

Specifically, in FIG. 5, it is assumed that the distance from the speaker SP1 to the listener L1 is "dF1", the distance from the speaker SP1 to the listener L2 is "dF2", the distance from the speaker SP2 to the listener L1 is "dR1" and the distance from the speaker SP2 to the listener L2 is "dR2". As to the listener L1, the distance difference of the speakers SP1, SP2 is:

$$D1=dF1-dR1 \tag{2}$$

and the delay amount Z1 is:

$$Z1=D1/c \tag{3}$$

Therefore, for each frequency band of the sound signal, the necessary phase difference θ(f) is obtained based on its frequency and the delay amount Z1.

Similarly, as to the listener L2, the distance difference of the speakers SP1, SP2 is:

$$D2=dF2-dR2 \tag{4}$$

and the delay amount Z2 is:

$$Z2=D2/c \tag{5}$$

Therefore, for each frequency band of the sound signal, the necessary phase difference θ(f) is obtained based on its frequency and the delay amount Z2.

Next, description will be given of the range of the control frequency band and the phase difference according to the first embodiment. In this embodiment, the phase difference θ(f) is given such that the both-ear level sum of the sound signals outputted from two speakers becomes large at both two listening positions, compared with the case where the sound signal is outputted from each speaker. Here, since there is a distance between those two listening points, it is difficult to make the both-ear level sum large in an entire frequency band (i.e., an audible frequency band of human being) of the sound signal. Namely, it is possible to make the both-ear level sum at the two listening positions large only in a certain frequency band. This certain frequency band, at which the both-ear level sum at both two listening positions can be large, will be hereinafter referred to as "control frequency band". In theory, the shorter the distance between the two listening points is, the broader the control frequency band can be.

Figure 6:
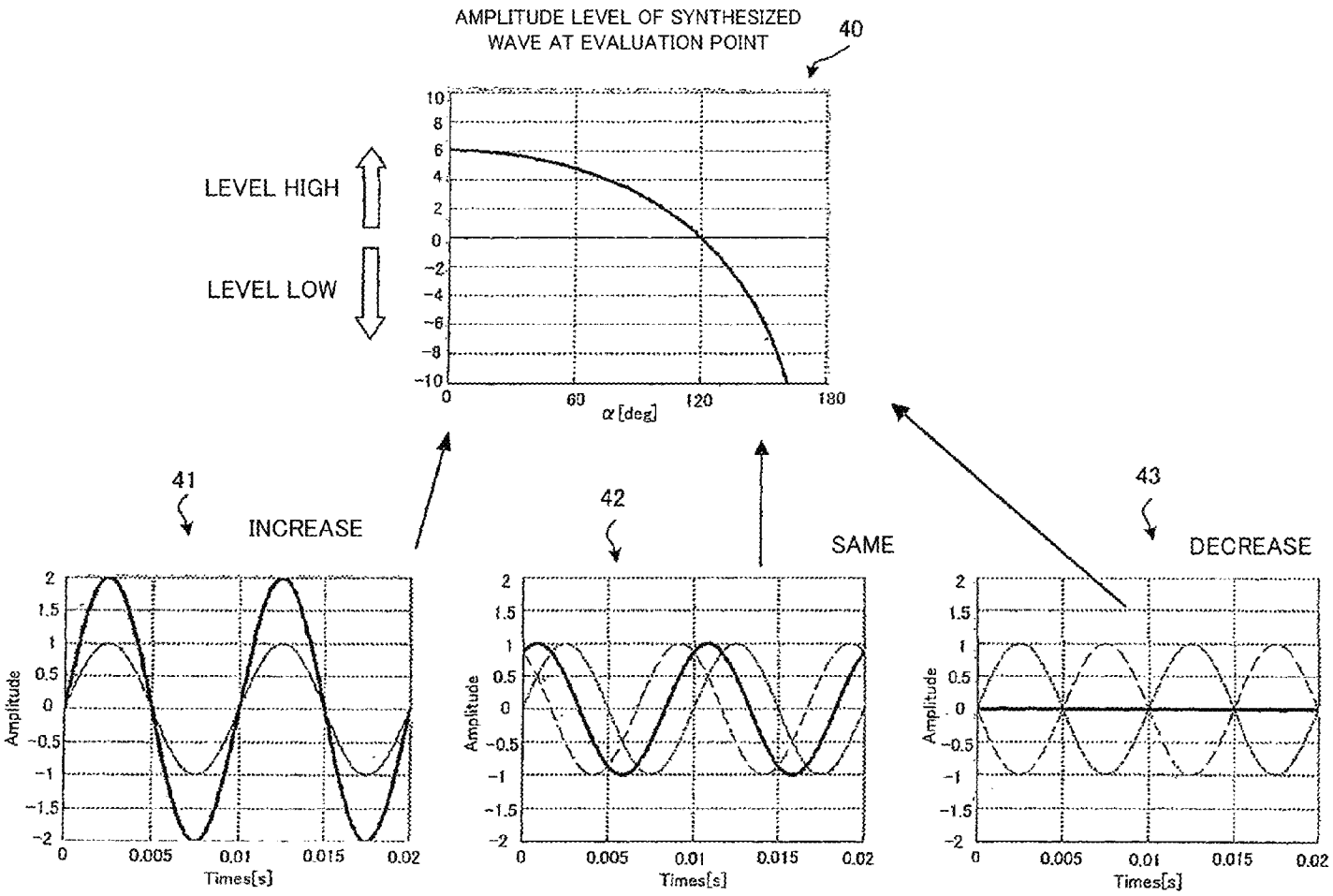
FIG. 6 illustrates amplitude levels of synthesized waves formed by synthesizing two sine waves with different phase difference.

Now, a level of a signal created by synthesizing two signals with a phase difference will be considered. FIG. 6 shows the amplitude level of the synthesized wave created by synthesizing two sine waves with a different phase difference. When two sin waves are synthesized in-phase (the phase difference=0), the amplitude of the synthesized wave becomes twice the amplitude of the original sine wave as shown by the graph 41. When two sine waves are synthesized with the phase difference 120 degrees, the amplitude of two sine waves is equal to the amplitude of the synthesized wave. On the other hand, when two sine waves are synthesized with reversed phase (the phase difference=180 degrees), the amplitude of the synthesized wave becomes smaller than the amplitude of the original sine wave as shown by the graph 43.

As shown by the graph 40, when the phase difference is 0-120 degrees, the amplitude of the synthesized wave of two sine waves is at least equal to or larger than the amplitude of the original sine wave. On the other hand, when the phase difference is larger than 120 degrees, the amplitude of the synthesized wave of two sine waves is smaller than the amplitude of the original sine wave. Therefore, in order to make the both-ear level sum large at both two listening positions, it is necessary that the phase difference given to the sound signals outputted from the two speakers becomes within 120 degrees. Here, considering the frequency of the sound signals outputted from the speakers, the range of the phase difference 120 degrees is broad for the low frequency, but the range of the phase difference 120 degrees becomes narrower as the frequency becomes higher. Therefore, as the frequency becomes higher, it becomes more difficult to maintain the phase difference of the sound signals outputted from the two speakers within the range of 120 degrees. In other words, the control frequency band, at which the both-ear level sum becomes large at both two listening positions, is limited on the high frequency side. Accordingly, the control frequency band in this embodiment ranges from a lower limit of the audible frequency band to a certain upper limit frequency band Fmax.

Specifically, by the above-mentioned equations (2), (4), the difference D of the distances to the listeners L1 and L2 is obtained as:

$$D=|D1-D2| \tag{6}$$

The upper limit frequency band Fmax is obtained as follows.

Upper limit frequency band Fmax:

$$\text{Frequency } F \text{ satisfying } F\cdot D/c<1/3 \tag{7}$$

Here, "⅓" indicates 120°/360° (Phase Difference).

As an example of a vehicle, it is assumed that the distance dF1 from the speaker SP1 to the listener L1 is 1.46 [m], the distance dF2 from the speaker SP1 to the listener L2 is 1.03 [m], the distance dR1 from the speaker SP2 to the listener L1 is 1.30 [m], and the distance dR2 from the speaker SP2 to the listener L2 is 0.79 [m]. In this case, by the equation (7), the upper limit frequency band Fmax is 1420 Hz.

Next, when the phase difference with which the both-ear level sum becomes maximum at the position of the listener L1 is indicated as "$\theta_A$", the range of the phase difference in which the both-ear level sum becomes large at both two listening position is obtained as:

$$\theta_A-120°+D\cdot F/c\times 360°<\theta<\theta_A+120° \tag{8}$$

Here, the part "D·F/c×360°" corresponds to the limit necessary to make the both-ear level sum large at the listening position L2. Namely, only for the listener L1, the both-ear level sum can be larger than that in the case of outputting the sound signal only by one speaker in the range of ±120° of the phase difference $\theta_A$. Within this range, the range of the phase difference in which the both-ear level sum can be large also for the listener L2 is narrowed by "D·F/c×360°".

Figure 7A:
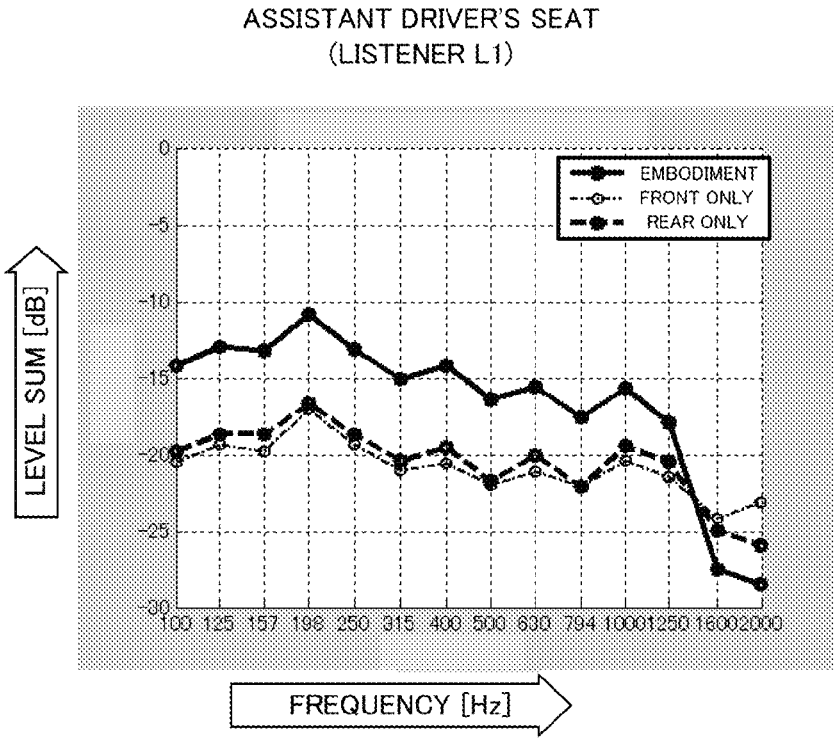
FIGS. 7A and 7B are diagrams illustrating characteristics of both-ear level sum according to a first embodiment.
Figure 7B:
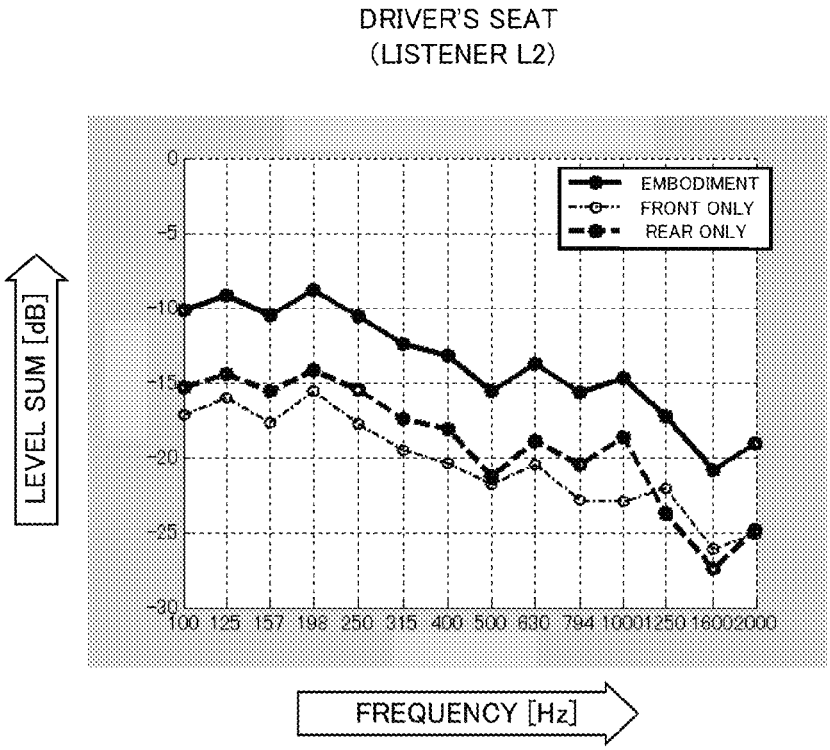

FIGS. 7A and 7B show characteristics when the phase difference θ(f) thus calculated is given. FIG. 7A shows a frequency characteristic of the both-ear level sum at the position of the listener L1 (the assistant driver's seat), and FIG. 7B shows a frequency characteristic of the both-ear level sum at the position of the listener L2 (the driver's seat). The horizontal axis indicates the frequency, and the vertical axis indicates the both-ear level sum. It is noted that those characteristics are obtained for the vehicle having the size described above as an example.

As shown in FIG. 7A, at the position of the listener L1, the both-ear level sum in the case of giving the phase difference as described above according to this embodiment is larger than the both-ear level sum in the case of reproducing the sound signal only from the front speaker SP1 or the rear speaker SP2 up to the upper limit frequency band Fmax (1420 Hz). In contrast, as shown in FIG. 7B, at the position of the listener L2, the both-ear level sum in the case of giving the phase difference as described above according to this embodiment is larger than the both-ear level sum in the case of reproducing the sound signal only from the front speaker SP1 or the rear speaker SP2 in an entire frequency band. Therefore, the both-ear level sum becomes large at both two listening positions within the control frequency band up to the upper limit frequency band Fmax.

Figure 8A:
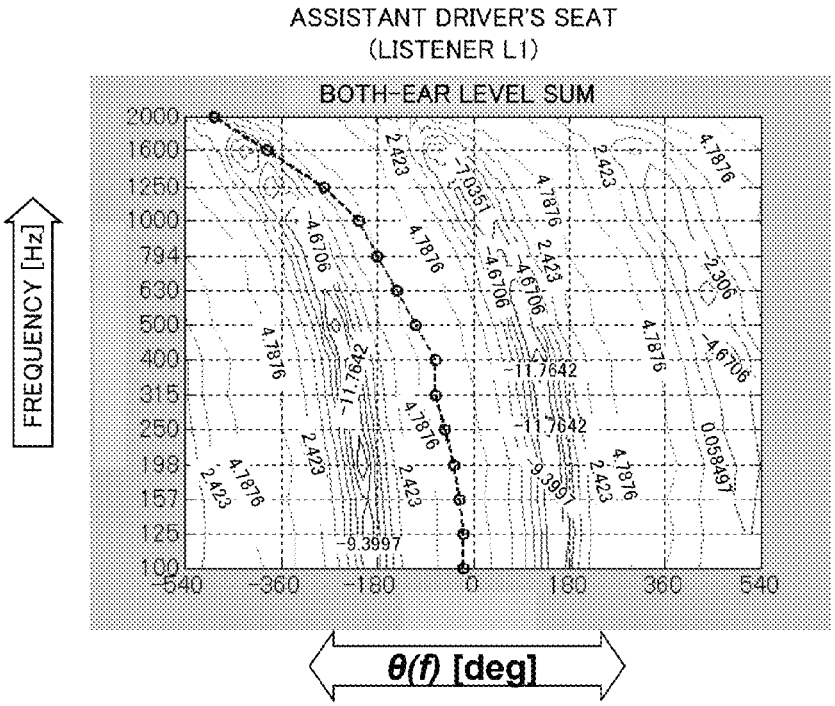
FIGS. 8A and 8B are diagrams illustrating characteristics of both-ear level sum according to the first embodiment.
Figure 8B:
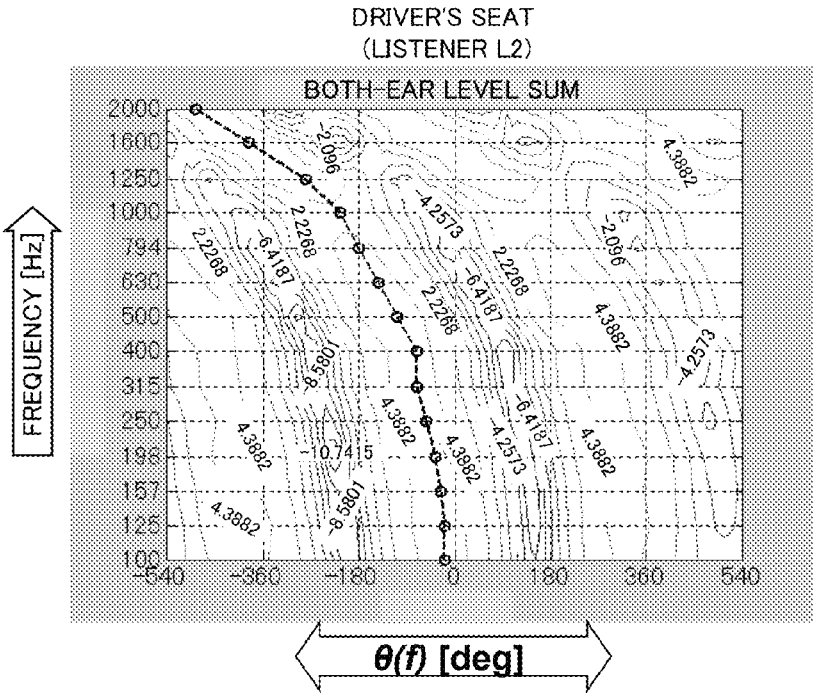

FIGS. 8A and 8B show calculation result of the phase difference. FIG. 8A shows variation of the both-ear level sum at the position of the listener L1 (the assistant driver's seat), and FIG. 8B shows variation of the both-ear level sum at the position of the listener L2 (the driver's seat). The horizontal axis indicates the phase difference θ(f), and the vertical axis indicates the frequency.

As shown in FIG. 8A, when the phase difference θ(f) shown by the dot line is given, the both-ear level sum passes through the area of high value, approximately 4.7 dB. As shown in FIG. 8B, when the phase difference θ(f) shown by the dot line is given, the both-ear level sum passes through the area of high value, approximately 4.3 dB. Namely, by giving the phase difference θ(f) calculated as described above to the sound signals reproduced from the two speakers, the both-ear level sum can be large for both of the listeners L1 and L2.

Figure 9:
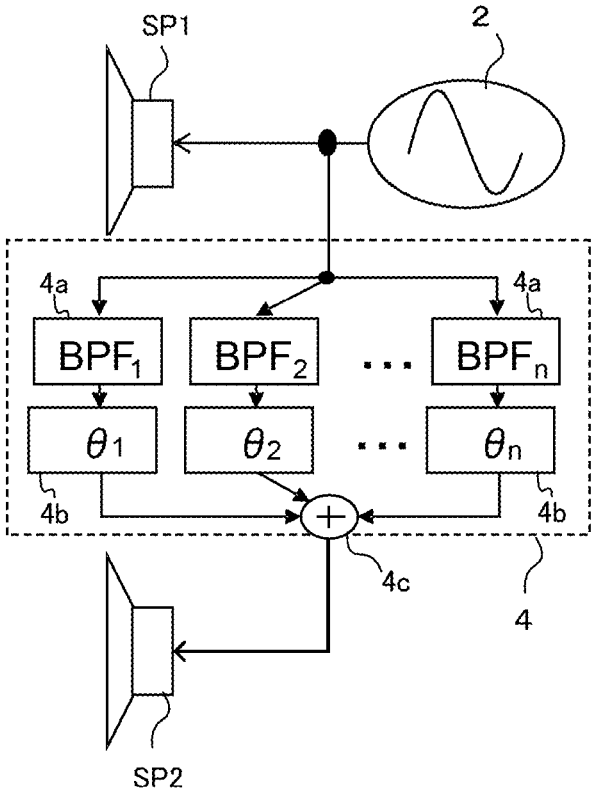
FIG. 9 is illustrates a configuration of a phase control unit according to the first embodiment.

FIG. 9 shows a configuration to give the phase difference θ(f) to the reproduced signals of the two speakers. The sound signal outputted from the sound source 2 is directly supplied to the speaker SP1 and is supplied to the speaker SP2 via the phase control unit 4. The phase control unit 4 includes a plurality of band-pass filters 4*a*, a plurality of phase adjusters 4*b*, and an adder 4*c*. The band-pass filters 4*a* are provided for the divided frequency bands of the sound signal, and divide the inputted sound signal to a plurality of frequency bands. The band-pass filters 4*a* supplies the sound signal of the respective frequency bands to the phase adjusters 4*b*. The phase adjuster 4*b* give the phase difference θ(f) calculated as described above to the sound signal and outputs it to the adder 4*c*. The adder 4*c* adds the output signals from the phase adjusters 4*b* of the respective frequency bands, and supplies the sum signal to the speaker SP2.

Figure 10:
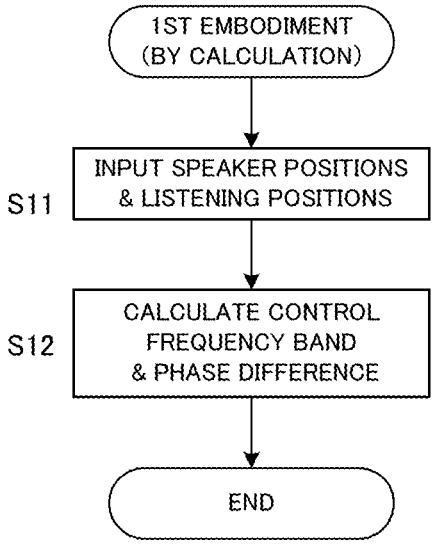
FIG. 10 illustrates a procedure according to the first embodiment.

FIG. 10 shows a procedure of the processing according to the first embodiment. This processing is executed by a computing device such as a computer.

First, the user measures the positions of the speakers and the seats in the vehicle, and inputs the speaker positions and the listening positions to the computing device. The computing device receives those positions (step S11). Specifically, the distances dF1, dF2, dR1 and dR2 shown in FIG. 5 are inputted to the computing device. Next, the computing device calculates the control frequency band and the phase difference θ(f) based on the above-mentioned equations.

The phase difference θ(f) thus determined is given to the phase control unit 4 shown in FIG. 9. Specifically, a coefficient corresponding to the phase difference θ(f) is set to the phase adjuster 4*b* of each frequency band in the phase control unit 4. Thus, an appropriate phase difference θ(f) is given to the sound signal reproduced from the speaker SP2 in the configuration of FIG. 9.

2nd Embodiment

Figure 11:
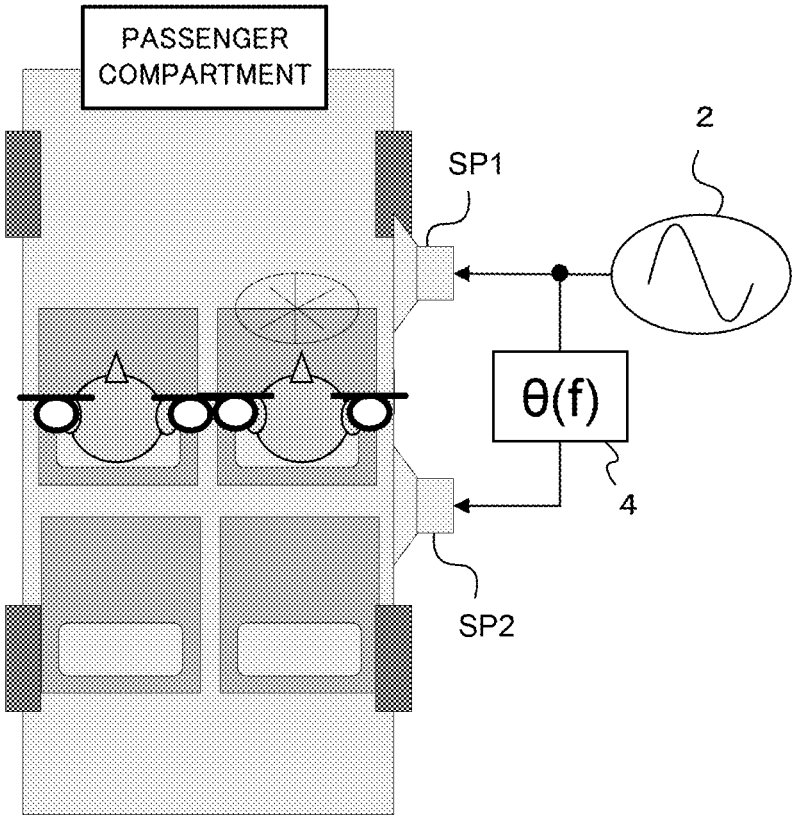
FIG. 11 illustrates a schematic configuration of a second embodiment of the sound reproduction device of the present invention.

Next, a second embodiment will be described. FIG. 11 illustrates a schematic configuration of the second embodiment of the sound reproduction device. The second embodiment supposes that the acoustic space is a passenger compartment. As shown in FIG. 11, the front speaker SP1 and a rear speaker SP2 are arranged on the right side of the driver's seat. The sound signal from the sound source 2 is supplied to the front speaker SP1 and is supplied to the rear speaker SP2 after its phase is corrected by the phase control unit 4.

Also in the second embodiment, the phase control unit 4 gives the different phase difference (the phase correction value) θ(f) for each frequency band of the sound signal. In the second embodiment, the phase difference θ(f) is calculated based on the transfer function between two speakers and two listening positions. Specifically, the transfer function between each speaker SP1, SP2 and the both ears of the listeners L1, L2 (i.e., the evaluation point) is obtained based on the positional relation between the two speakers SP1, SP2 and the listeners L1, L2, and distribution of the both-ear level sum corresponding to the phase and the frequency is generated based on the transfer function by simulation or else.

Figure 12A:
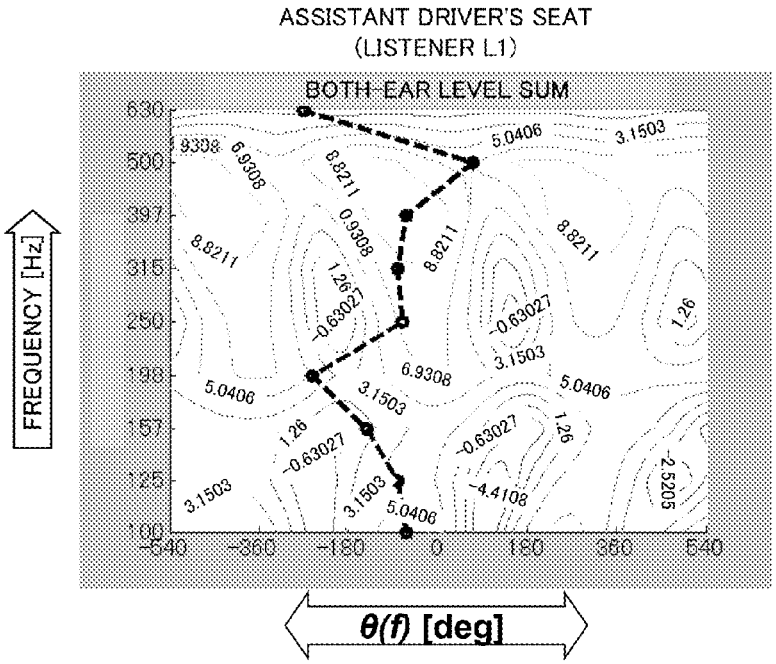
FIGS. 12A and 12B are diagrams illustrating characteristics of both-ear level sum according to a second embodiment.
Figure 12B:
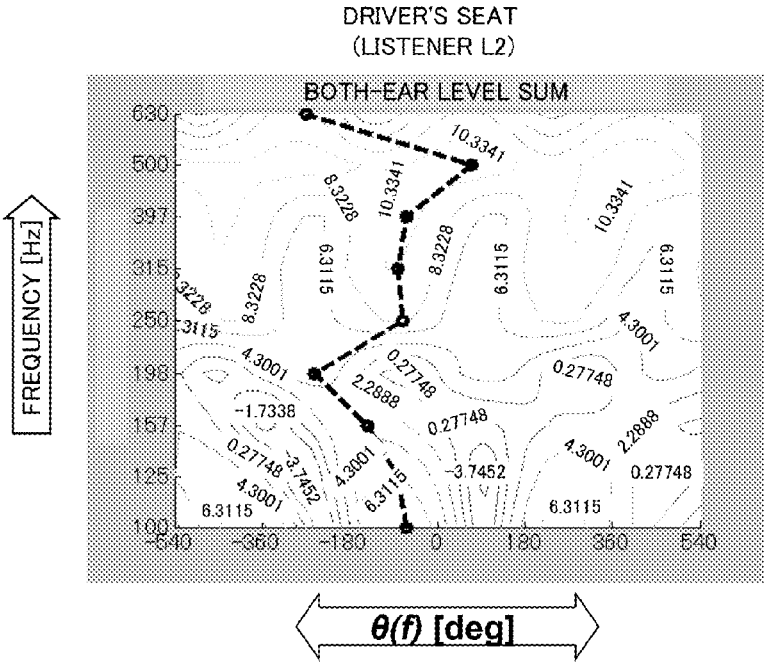

FIG. 12 shows examples of the distribution diagrams thus generated. FIG. 12A shows variation of the both-ear level sum at the position of the listener L1 (the assistant driver's seat), and FIG. 12B shows variation of the both-ear level sum at the position of the listener L2 (the driver's seat). In these distribution diagrams, the phase difference indicated by the broken line and connecting the area having highest both-ear level sum indicates the phase difference θ(f) given to the sound signal inputted to two speakers at each frequency band.

Figure 13A:
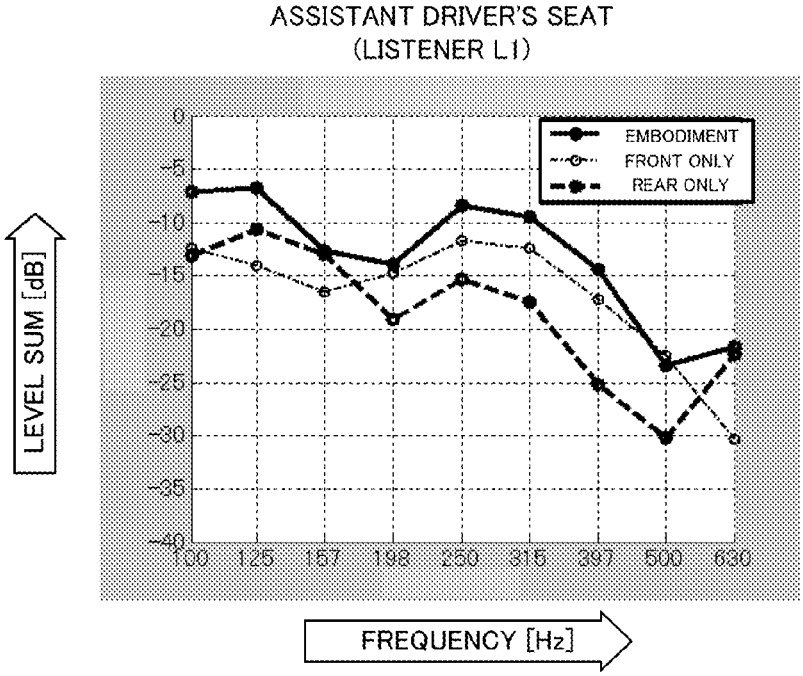
FIGS. 13A and 13B are diagrams illustrating characteristics of both-ear level sum according to the second embodiment.
Figure 13B:
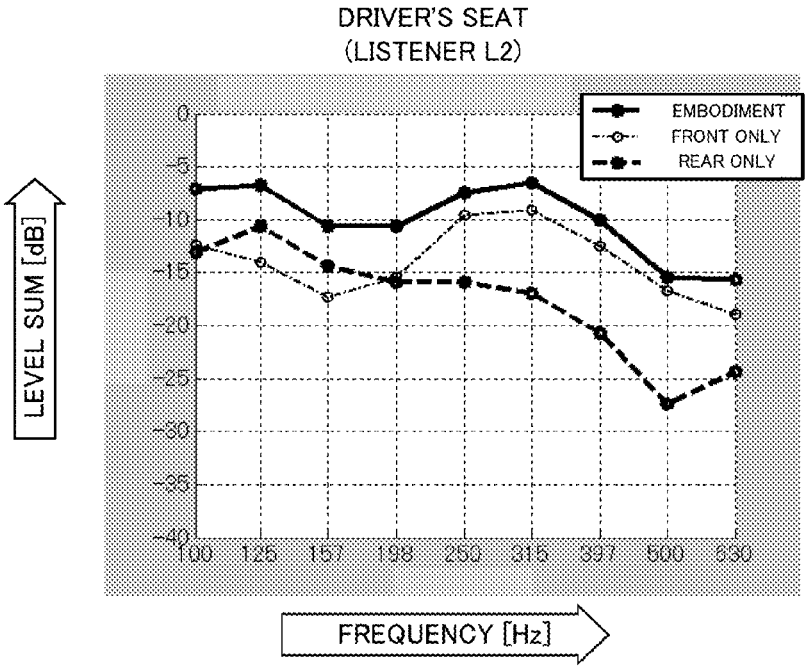

FIGS. 13A and 13B show characteristics when the phase difference θ(f) obtained as described above is given. FIG. 13A shows a frequency characteristic of the both-ear level sum at the position of the listener L1 (the assistant driver's seat), and FIG. 13B shows a frequency characteristic of the both-ear level sum at the position of the listener L2 (the driver's seat). The horizontal axis indicates the frequency, and the vertical axis indicates the both-ear level sum.

As shown in FIG. 13A, at the position of the listener L1, the both-ear level sum in case of giving the above-mentioned phase difference is equal to or larger than the both-ear level sum in case of reproducing the sound signal only by the front speaker SP1 or the rear speaker SP2, up to 400 Hz corresponding to the upper limit frequency band Fmax. It is noted that the both-ear level sum of this embodiment is close to the both-ear level sum in case of reproducing the sound signal only by the front speaker SP2 around 157 Hz, and the both-ear level sum of this embodiment is close to the both-ear level sum in case of reproducing the sound signal only by the front speaker SP1 around 198 Hz. This is considered to be peculiar to the configuration of the compartment of the vehicle used in this embodiment.

In contrast, as shown in FIG. 13B, at the position of the listener L2, the both-ear level sum in case of giving the phase difference as described in this embodiment is larger than the both-ear level sum in case of reproducing the sound signal only from the front speaker SP1 or the rear speaker SP2 in an entire frequency band. Therefore, also in this embodiment, the both-ear level sum becomes large at both two listening positions within the control frequency band up to the upper limit frequency band Fmax.

In the second embodiment, the configuration necessary to give the phase difference θ(f) to the sound signals supplied to the two speakers is the same as that of the first embodiment shown in FIG. 9.

Figure 14:
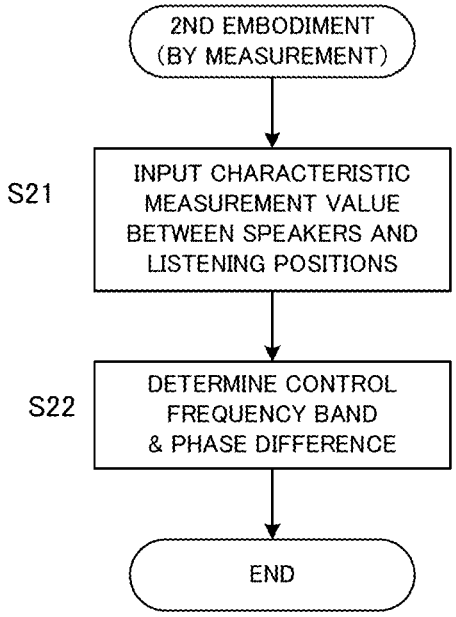
FIG. 14 illustrates a procedure according to the second embodiment.

FIG. 14 shows a procedure of the processing according to the second embodiment. This processing is executed by the computing device such as a computer.

First, the user outputs the test signal from two speakers, and collects the test signal by microphones arranged at the positions of the listeners L1, L2, thereby to measure the characteristics between the speakers and the listening positions. Then, the user inputs the measured values to the computing device, and the computing device receives those values (step S21).

Next, the computing device generates the distribution of the both-ear level sum as shown in FIGS. 12A and 12B based on the measured values thus inputted, and determines the control frequency band and the phase difference θ(f) based on the distribution. Specifically, the computing device determines the phase difference such that the both-ear level sum becomes as close to the maximum value as possible at both positions of the listeners L1 and L2 at each frequency band in the distribution of the both-ear level sum. Also, the computing device determines the frequency, at which the both-ear level sum becomes not larger than the both-ear level sum in case of outputting the sound signal from one of the speakers at either one of the position of the listeners L1 and L2, as the upper limit frequency band, and determines the control frequency band whose upper limit is the upper limit frequency band.

The phase difference θ(f) thus determined is given to the phase control unit 4 shown in FIG. 9, and the coefficient corresponding to the phase difference θ(f) is set to the phase adjuster 4*b* of each frequency band in the phase control unit 4. In this way, an appropriate phase difference θ(f) is given to the sound signal reproduced by the speaker SP2 in the configuration of FIG. 9.

Figure 15A:
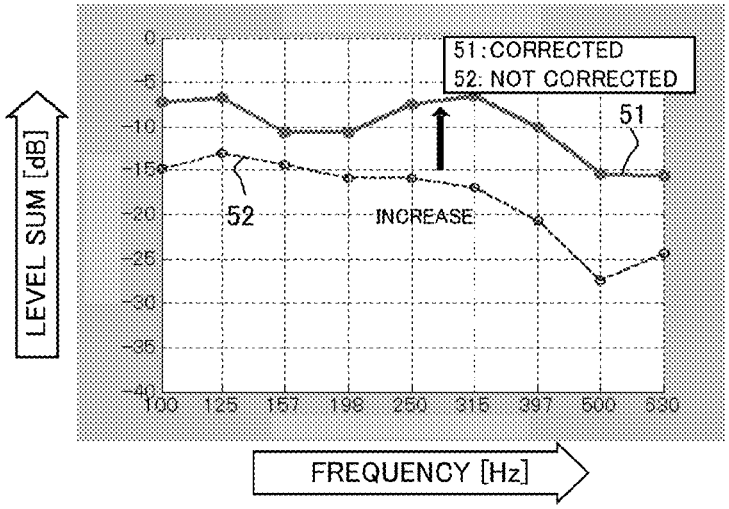
PRIOR ART FIG. 15A
FIGS. 15A to 15C illustrate a level increase effect by a prior art.
Figure 15B:
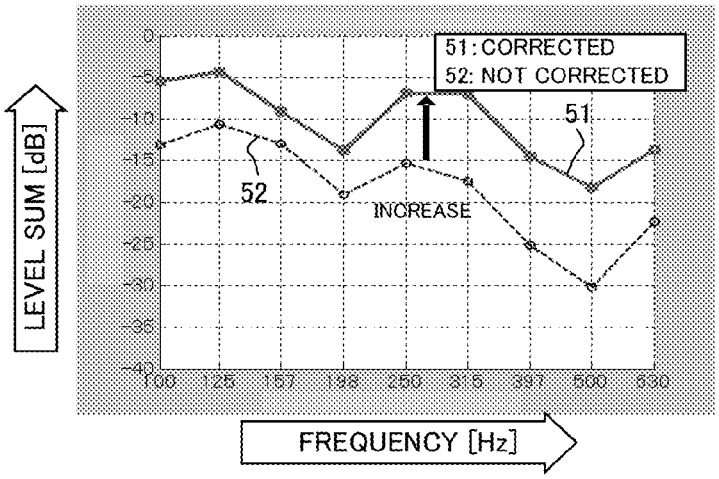
Figure 15C:
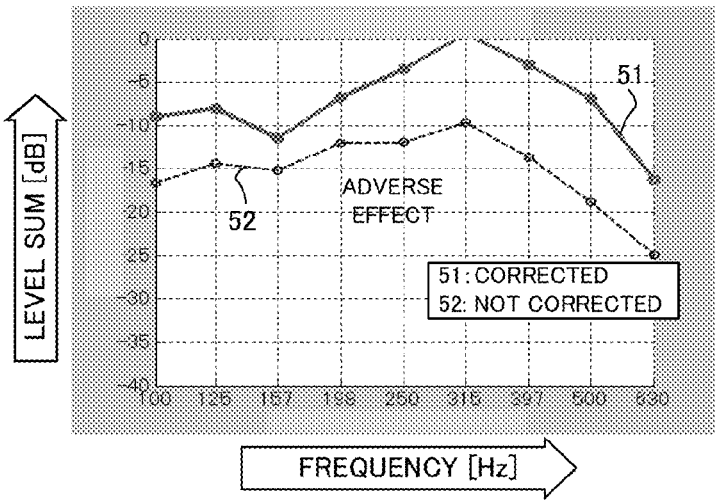
Figure 16A:
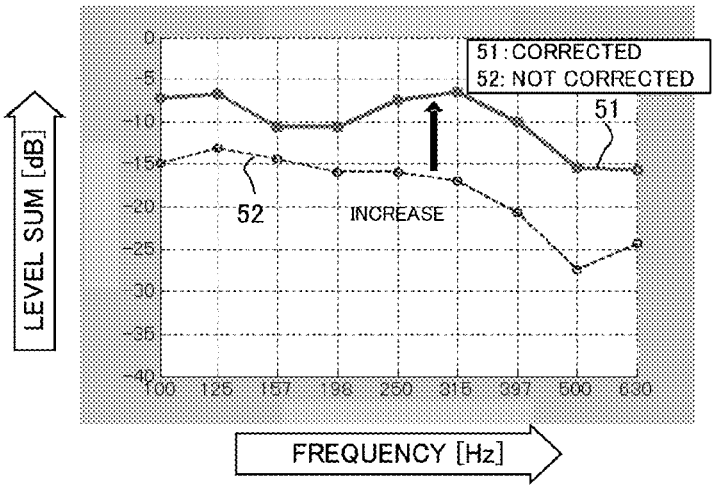
FIGS. 16A to 16C illustrate the level increase effect by the second embodiment.
Figure 16B:
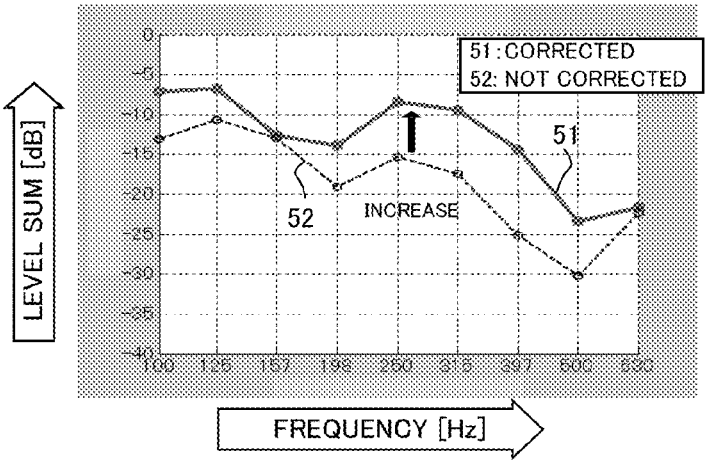
Figure 16C:
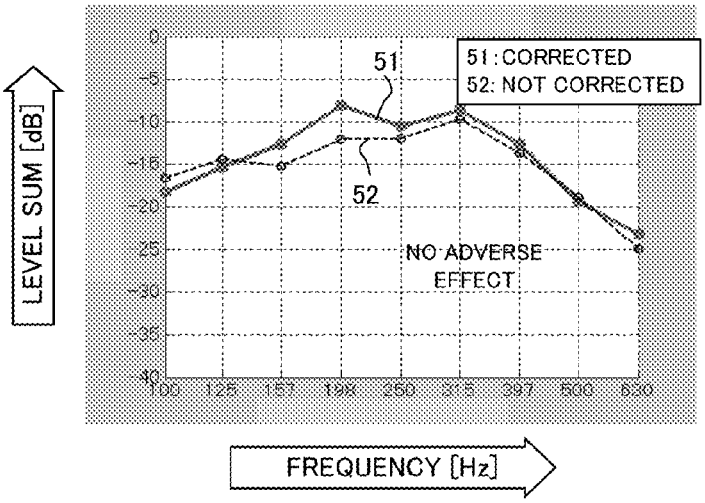

FIGS. 15A to 15C and 16A to 16C show the effect of the conventional method and the second embodiment. FIGS. 15A to 15C show the both-ear level sum at the driver's seat, the assistant driver's seat and the rear seat according to the conventional method, and FIGS. 16A to 16C show the both-ear level sum at the driver's seat, the assistant driver's seat and the rear seat according to the second embodiment. The conventional method means a method of increasing the reproduced sound from the rear speaker at a certain frequency band by equalizer to increase the both-ear level sum at the driver's seat.

When the reproduced sound from the rear speaker is increased by the conventional method, the both-ear level sum increases at the driver's seat and the assistant driver's seat as shown in FIGS. 15A and 15B. However, as shown in FIG. 15C, the both-ear level sum further becomes large at the rear seat compared with the driver's seat, and the reproduced sound disadvantageously becomes too large at the rear seat.

In contrast, according to the method of the second embodiment, by the phase correction of giving the phase difference θ(f), the both-ear level sum increases at the driver's seat and the assistant driver's seat as shown in FIGS. 16A and 16B. However, since the both-ear level sum does not vary so much at the rear seat as shown in FIG. 16C, there occurs no such disadvantage that the reproduced sound becomes too large at the rear seat. In this way, according to the second embodiment, it is possible to increase the reproduced sound level at the driver's seat without giving any adverse effect to the reproduced sound level at other seats.

[Relation between Speakers and Listening Positions]

Next, the description will be given of the relation between the two speaker positions and the listening positions in the embodiments.

Figure 17A:
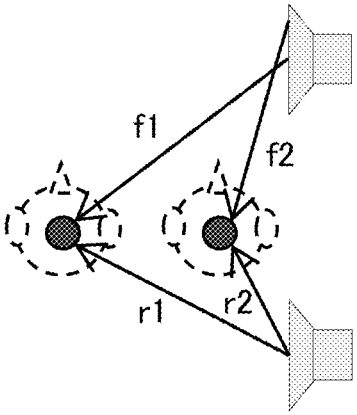
FIGS. 17A and 17B are diagrams for considering positional relations between speakers and listening positions.
Figure 17B:
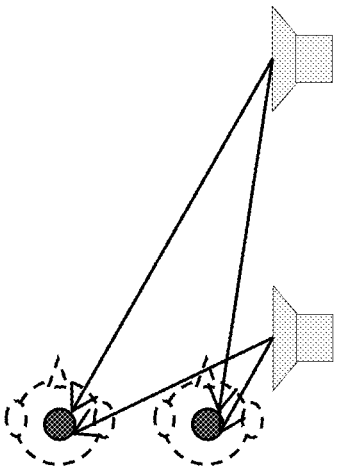

As shown in FIG. 17A, according to the embodiments of the present invention, two speakers are arranged so as to sandwich the driver's seat and the assistant driver's seat in the front-rear direction. In other words, two listening positions are located between two speakers in the front-rear direction of the vehicle. Therefore, the distance differences D1, D2 between each listening position and two speakers are small. As already explained, since the distance differences correspond to the correction amount of the sound signal supplied to two speakers, i.e., the phase difference θ(f), the reproduced sounds at two listening positions can be more easily synchronized with small correction amount, as the distance difference D1, D2 are smaller. Therefore, assuming the environment such as the passenger compartment, it is possible to increase the both-ear level sum at both two listening positions if there are two listening positions.

On the contrary, when two listening positions are arranged outside two speakers in the front-rear direction, the distance differences D1, D2 between each listening position and two speakers become large, and hence it becomes difficult to synchronize the reproduced sounds at two listening positions. Namely, the correction amount of the sound signal, i.e., the phase difference θ(f) must be large, and it is difficult to increase the both-ear level sum at both of two listening positions. In this way, according to the embodiments, it is the premise to increase the both-ear level sum at both of two listening positions that a pair of speakers is arranged in the front-rear direction with respect to two listening positions.

In addition, by arranging two speakers in the front-rear direction with respect to two listening positions, there is such an advantage that the influence to the rear seats can be reduced. According to the method of the embodiment, the sound is reproduced from two speakers SP1 and SP2, but the influence to the person at the rear seat is small. Namely, the person at the rear seat does not feel that the reproduced sound is noisy. There are two reasons for this. The first reason is that, since there is a certain distance between the front speaker SP1 and the rear seat and there is an obstacle such as a seat between the front speaker and the rear seat, basically the reproduced sound from the front speaker SP1 is difficult to reach the rear seat. The second reason is that, since the rear seat is positioned outside two speakers, the reproduced sounds from two speakers are difficult to synchronize as described above. This will be further explained with reference to FIGS. 18A and 18B.

Figure 18A:
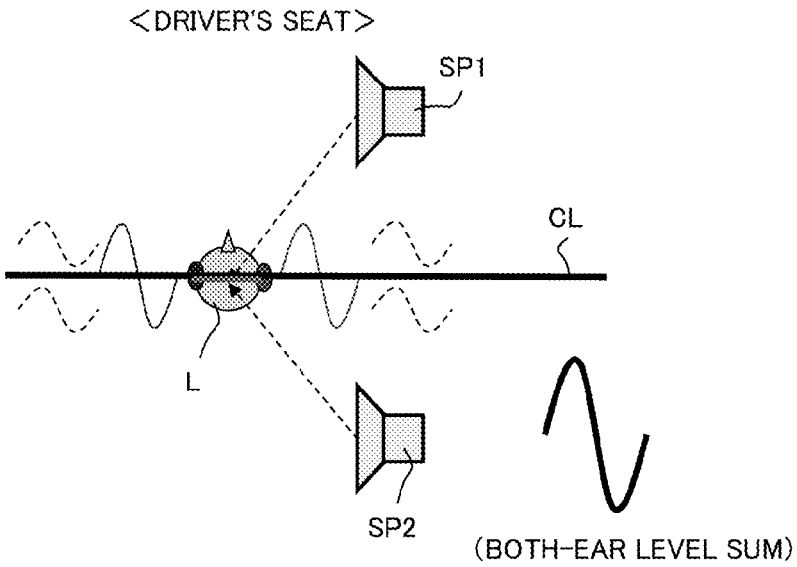
FIGS. 18A and 18B illustrate relationship between an axis on which reproduced sounds by two speakers synchronize and a listening position.
Figure 18B:
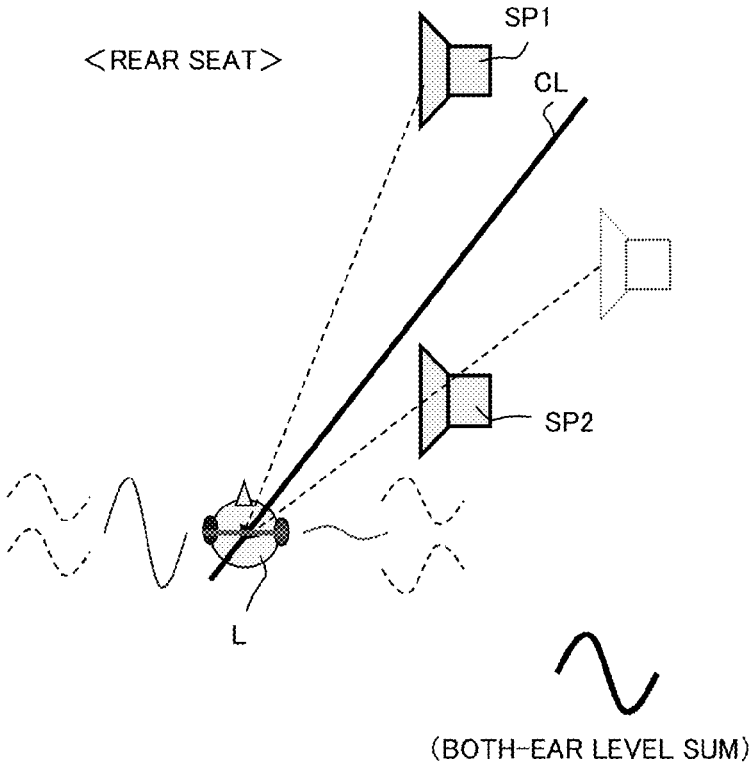

FIGS. 18A and 18B show the positional relation between two speakers and the listener L. As shown in FIG. 18A, when the sounds are reproduced from two speakers SP1 and SP2, the axis at which the reproduced sounds from two speakers synchronize with each other is the center line CL of two speakers. When the listener L is located inside two speakers, the both ears of the listener L exist on or near the center line CL, and therefore the reproduced sounds reaching the both ears synchronize with each other and the both-ear level sum easily varies.

On the contrary, as shown in FIG. 18B, when the listener L is located outside two speakers SP1 and SP2, even if the listener L exists on the center line CL on which the reproduced sounds from two speakers synchronize with each other, the both-ear level sum hardly varies because the direction connecting the both ears of the listener deviates from the center line CL. Therefore, in the embodiments of the present invention, even if the sounds are reproduced by the front speaker SP1 and the rear speaker SP2, the sound pressure at the rear seat does not become excessively large and the passenger at the rear seat does not feel the reproduced sound noisy.

In the embodiments described above, the both-ear level sum at the driver's seat, i.e., the front seat on the right side is increased by using the front speaker and the rear speaker arranged on the right side of the passenger compartment. By the same method, the both-ear level sum at the assistant driver's seat, i.e., the front seat on the left side may be increased by the front speaker and the rear speaker arranged on the left side of the passenger compartment.

DESCRIPTION OF REFERENCE NUMBERS

2 Sound Source
3 Dummy Head
4 Phase Control unit
SP1 Front Speaker
SP2 Rear Speaker
L1, L2 Listening Position

The invention claimed is:

1. A sound reproduction device comprising:

plural speakers arranged in front of and behind a plurality of listening positions, the plural speakers including a first speaker arranged in front of the plurality of listening positions and a second speaker arranged behind the plurality of listening positions, each of the plurality of listening positions having two evaluation points set in an acoustic space;

an input unit which receives a sound signal; and a phase control unit which controls a phase of the sound signal and supplies the sound signals to the plural speakers, wherein the phase control unit determines, for each of the plurality of listening positions, a phase difference based on one of the group consisting of i) positional relation between each of the plural speakers and the listening positions, and ii) measurement data obtained by collecting sounds reproduced from the plural speakers at the listening positions, such that a sum of reproduced sound levels at the two evaluation points becomes larger than the sum obtained in a case where the sound signal is reproduced from only one of the plural speakers, and controls the sound signals supplied to the plural speakers.

2. The sound reproduction device according to claim 1, wherein the phase control unit calculates the control frequency band and the phase difference based on distances between the plural speakers and the listening points.

3. The sound reproduction device according to claim 1, wherein the phase control unit determines the control frequency band and the phase difference based on measured data obtained by collecting sound reproduced by the speakers at the listening positions.

4. The sound reproduction device according to claim 1, wherein one of the plural speakers is arranged on an opposite side of the other of the plural speakers with respect to a line segment connecting the plurality of listening positions.

5. The sound reproduction device according to claim 1, wherein the two evaluation points correspond to positions of two ears of a listener positioned at the listening position.

6. The sound reproduction device according to claim 1, wherein the sound space is a passenger compartment of a vehicle, wherein the first speaker is a front speaker and the second speaker is a rear speaker, each of the front speaker and the rear speaker being arranged at a right side or a left side in the passenger compartment, wherein the plurality of listening positions correspond to a driver's seat and an assistant driver's seat in the passenger compartment, and wherein the two evaluation points correspond to positions of left and right ears of a listener positioned at the driver's seat and the assistant driver's seat.

7. A sound reproduction method executed by a sound reproduction device including plural speakers arranged in front of and behind a plurality of listening positions, the plural speakers including a first speaker arranged in front of the plurality of listening positions and a second speaker arranged behind the plurality of listening positions, each of the plurality of listening positions having two evaluation points set in an acoustic space, comprising:

an input process which receives a sound signal; and a phase control process which controls a phase of the sound signal and supplies the sound signals to the plural speakers, wherein the phase control process determines, for each of the plurality of listening positions, a control frequency band and a phase difference such that a sum of reproduced sound levels at the two evaluation points becomes larger than the sum obtained in a case where the sound signal is reproduced from one of the plural speakers, and controls the sound signals supplied to the plural speakers.

8. A non-transitory computer-readable medium storing a sound reproduction program executed by a computer in a sound reproduction device including plural speakers arranged in front of and behind a plurality of listening positions, the plural speakers including a first speaker arranged in front of the plurality of listening positions and a second speaker arranged behind the plurality of listening positions, each of the plurality of listening positions having two evaluation points set in an acoustic space, the program causing the computer to function as:

an input unit which receives a sound signal; and a phase control unit which controls a phase of the sound signal and supplies the sound signals to the plural speakers, wherein the phase control unit determines, for each of the plurality of listening positions, a control frequency band and a phase difference such that a sum of reproduced sound levels at the two evaluation points becomes larger than the sum obtained in a case where the sound signal is reproduced from one of the plural speakers, and controls the sound signals supplied to the plural speakers.

9. The sound reproduction device according to claim 2, wherein one of the plural speakers is arranged on an opposite side of the other of the pair of speakers with respect to a line segment connecting the plurality of listening positions.

10. The sound reproduction device according to claim 3, wherein one of the plural speakers is arranged on an opposite side of the other of the plural speakers with respect to a line segment connecting the plurality of listening positions.

11. The sound reproduction device according to claim 2, wherein the two evaluation points correspond to positions of two ears of a listener positioned at the listening position.

12. The sound reproduction device according to claim 3, wherein the two evaluation points correspond to positions of two ears of a listener positioned at the listening position.

13. The sound reproduction device according to claim 4, wherein the two evaluation points correspond to positions of two ears of a listener positioned at the listening position.

14. The sound reproduction device according to claim 2,
wherein the sound space is a passenger compartment of a vehicle,
wherein the first speaker is a front speaker and the second speaker is a rear speaker, each of the front speaker and the rear speaker being arranged at a right side or a left side in the passenger compartment,
wherein the plurality of listening positions correspond to a driver's seat and an assistant driver's seat in the passenger compartment, and
wherein the two evaluation points correspond to positions of left and right ears of a listener positioned at the driver's seat and the assistant driver's seat.

15. The sound reproduction device according to claim 3,
wherein the sound space is a passenger compartment of a vehicle,
wherein the first speaker is a front speaker and the second speaker is a rear speaker, each of the front speaker and the rear speaker being arranged at a right side or a left side in the passenger compartment,
wherein the plurality of listening positions correspond to a driver's seat and an assistant driver's seat in the passenger compartment, and
wherein the two evaluation points correspond to positions of left and right ears of a listener positioned at the driver's seat and the assistant driver's seat.

16. The sound reproduction device according to claim 4,
wherein the sound space is a passenger compartment of a vehicle,
wherein the first speaker is a front speaker and the second speaker is a rear speaker, each of the front speaker and the rear speaker being arranged at a right side or a left side in the passenger compartment,
wherein the plurality of listening positions correspond to a driver's seat and an assistant driver's seat in the passenger compartment, and
wherein the two evaluation points correspond to positions of left and right ears of a listener positioned at the driver's seat and the assistant driver's seat.

17. The sound reproduction device according to claim 1, wherein the phase control unit i) determines, for each of the plurality of listening positions, the phase difference based on the positional relation between each of the plural speakers and the listening positions, such that the sum of reproduced sound levels at the two evaluation points becomes larger than the sum obtained in a case where the sound signal is reproduced from one of the plural speakers, and ii) controls the sound signals supplied to the plural speakers.

18. The sound reproduction device according to claim 17, wherein,
the phase control unit further i) determines, for each of the plurality of listening positions, a control frequency band based on positional relation between each of the pair of speakers and the listening positions, such that, the sum of reproduced sound levels at the two evaluation points becomes larger than the sum obtained in the case where the sound signal is reproduced from one of the plural speakers, and ii) controls the sound signals supplied to the plural speakers.

19. The sound reproduction device according to claim 1, wherein the phase control unit i) determines, for each of the plurality of listening positions, the phase difference based on the measurement data obtained by collecting sounds reproduced from the plural speakers at the listening positions, such that a sum of reproduced sound levels at the two evaluation points becomes larger than the sum obtained in the case where the sound signal is reproduced from one of the plural speakers, and ii) controls the sound signals supplied to the plural speakers.

20. The sound reproduction device according to claim 19, wherein,
the phase control unit further i) determines, for each of the plurality of listening positions, a control frequency band based on the measurement data obtained by collecting sounds reproduced from the plural speakers at the listening positions, such that, the sum of reproduced sound levels at the two evaluation points becomes larger than the sum obtained in the case where the sound signal is reproduced from one of the plural speakers, and ii) controls the sound signals supplied to the plural speakers.

* * * * *